US005136741A

United States Patent [19]

Balonick et al.

[11] Patent Number: 5,136,741

[45] Date of Patent: Aug. 11, 1992

[54] MULTIPLE COMPONENT MATTRESS WITH REMOVABLE COVER

[75] Inventors: Arnold Balonick, Encino; Larry Lankard, Fallbrook; Curtis Wyatt, San Juan Capistrano, all of Calif.

[73] Assignee: B.G. Industries, Inc., Northridge, Calif.

[21] Appl. No.: 645,746

[22] Filed: Jan. 25, 1991

[51] Int. Cl.[5] ..... A47C 31/00; A47C 27/15

[52] U.S. Cl. ..... 5/470; 5/481; 5/465; 5/922

[58] Field of Search ..... 5/470, 464, 465, 481, 5/471

[56] References Cited

U.S. PATENT DOCUMENTS

| | | | |
|---|---|---|---|
| 1,211,548 | 1/1917 | Courts | 5/470 |
| 3,950,800 | 4/1976 | Garshfield | 5/470 |
| 4,388,738 | 6/1983 | Wagner | 5/470 |
| 4,706,313 | 4/1987 | Murphy | 5/470 |
| 4,930,170 | 6/1990 | Kobayashi | 5/470 |
| 4,955,095 | 9/1990 | Gerrick | 5/470 |

*Primary Examiner*—Alexander Grosz
*Attorney, Agent, or Firm*—Lewis Anten

[57] ABSTRACT

A mattress intended for use in hospital facilities, and having replaceable parts is disclosed. The mattress is made up of an upper layer of one foam material and a lower thicker layer, itself having two layers. The first lower layer is constructed to give a reclining body flexible support. The second lower layer supports and acts as a base for the first lower layer. The upper and lower foam layers are covered by a water and moisture impervious cover. The cover is formed in two halves, an upper half enclosing the upper layer on the top and sides and a lower half enclosing the lower layer on the bottom, the sides and a portion of the top. The two halves of the cover are joined together by a zipper around the side walls of the mattress to entirely enclose two inner foam layers.

6 Claims, 2 Drawing Sheets

FIG. 4
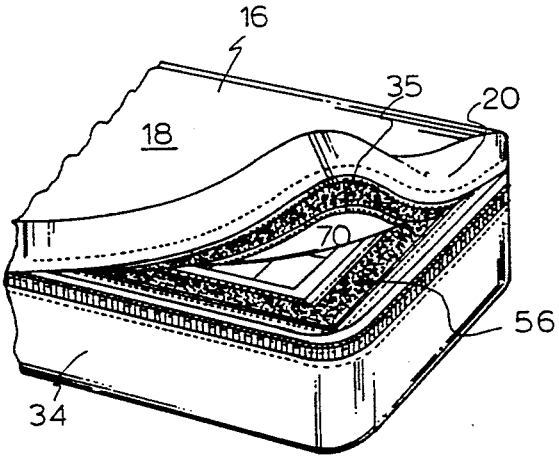
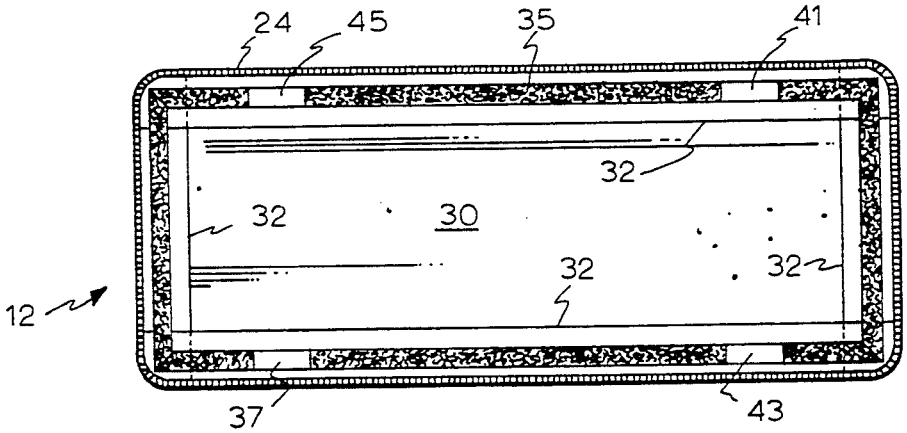
FIG. 5
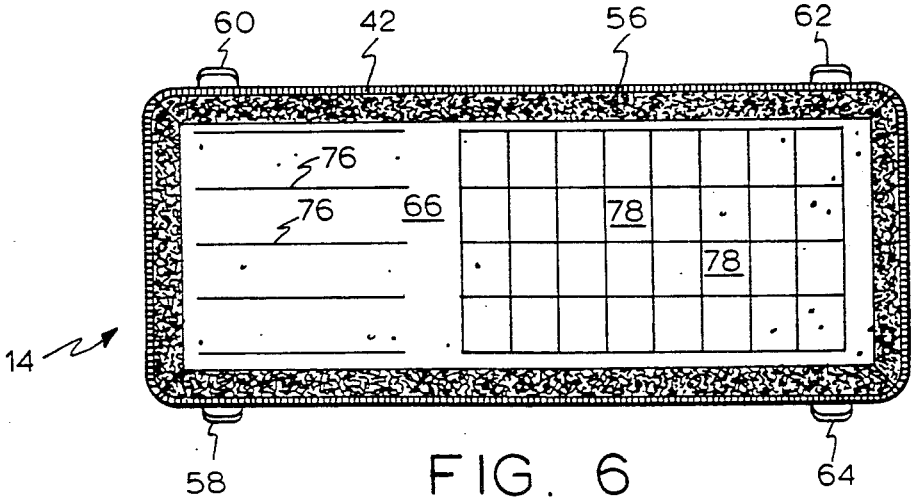
FIG. 6

MULTIPLE COMPONENT MATTRESS WITH REMOVABLE COVER

BACKGROUND

In conventional households, mattresses are used primarily only during the night. Such mattresses typically are made of a cloth fabric covering an inner box spring. However, such conventional box spring type mattresses are not acceptable for use in institutional facilities, where foam mattresses are used and have the advantage of reducing tissue trauma, such as bed sores, which result from the prolonged lying on mattresses. A number of foam mattresses for use in such institutional environments have been designed. Typically, the foam mattresses are enclosed by a cover made from a material that is impervious to passage of water or other liquids, such as urine, that typically would be experienced in the hospital environment, as well as being anti-bacterial and resistant to flame.

In a hospital environment there is a need to be able to replace component parts of a mattress which may be damaged or contaminated. For example, a sharp instrument, such as a needle, could pierce the cover and permit contaminated fluids to enter into the interior of the mattress. In such circumstance it would be desirable to replace the top cover, and the foam insert. However, in other instances, only the external cover may be damaged and the foam may still be useable. Finally, there are circumstances where only the foam may need to be replaced, such as where the foam may have been compressed during use by a prior patient. In such a case, the cover may remain perfectly usable.

There have been mattresses with component parts which may be interchanged with one another so that the entire mattress does not have to be disposed of in the above circumstances. B. G. Industries, Inc., has sold a mattress which had an internal foam upper and a lower layer, the upper layer having a cut out portion around its periphery forming a projecting segment that fit within a corresponding depression formed in the bottom foam layer. The foam pieces were enclosed by top and bottom covers attached by zippers to corresponding zipper assemblies permanently attached to the upper mattress layer.

Manufacturing such a mattress was time consuming and expensive. Further, it was bulky to ship since the two separate foam layers had to be separated during shipment. Typically a mattress of this nature is rolled up and shipped in a cylinder, conserving space. This prior art mattress did not permit the easy replacement of the components.

SUMMARY OF THE INVENTION

The mattress of the present invention has replaceable parts. An upper layer of one foam material and a lower thicker layer of a second foam material are covered by a water and moisture impervious cover. The cover is formed in two halves, an upper half enclosing the upper layer on the top and sides and a lower half enclosing the lower layer on the bottom, the sides and a portion of the top. The two halves of the cover are joined together by a single zipper around the side walls of the mattress to entirely enclose two inner foam layers. The portion of the lower half of the cover extends perpendicularly from the top of the side walls of the cover and has attachment means, such as loop and hook fasteners, for removable attachment of the lower cover to a complementary attachment means on the periphery of the bottom surface of the upper layer. The construction of the mattress of the present invention is simple and inexpensive to manufacture. The component parts may be replaced if damaged. Further, the upper and lower layers, as well as their covers, may be easily shipped.

OBJECTS OF THE INVENTION

It is an object of the present invention to provide an in hospital mattress that is easier to manufacture;

It is another object of the present invention to provide an in hospital mattress that is less expensive to manufacture;

It is yet another object of the present invention to provide an in hospital mattress that has readily replaceable component parts;

It is yet another object of the present invention to provide an in hospital mattress that reduces possibilities of contamination;

It is another object of the present invention to provide an in hospital mattress that is easy to assemble;

It is another object of the present invention to provide a mattress that can easily be shipped.

These and other objects of the present invention will be apparent from a review of the following specification and the accompanying drawings.

BRIEF DESCRIPTION OF THE DRAWINGS

FIG. 4 is a partial right top perspective view of a corner of the mattress of the present invention.

FIG. 5 is a plane view of the bottom of the top half of the mattress of the present invention.

FIG. 6 is a plane view of the top of the bottom half of the mattress of the present invention.

DESCRIPTION OF THE PREFERRED EMBODIMENT

Figure 1:
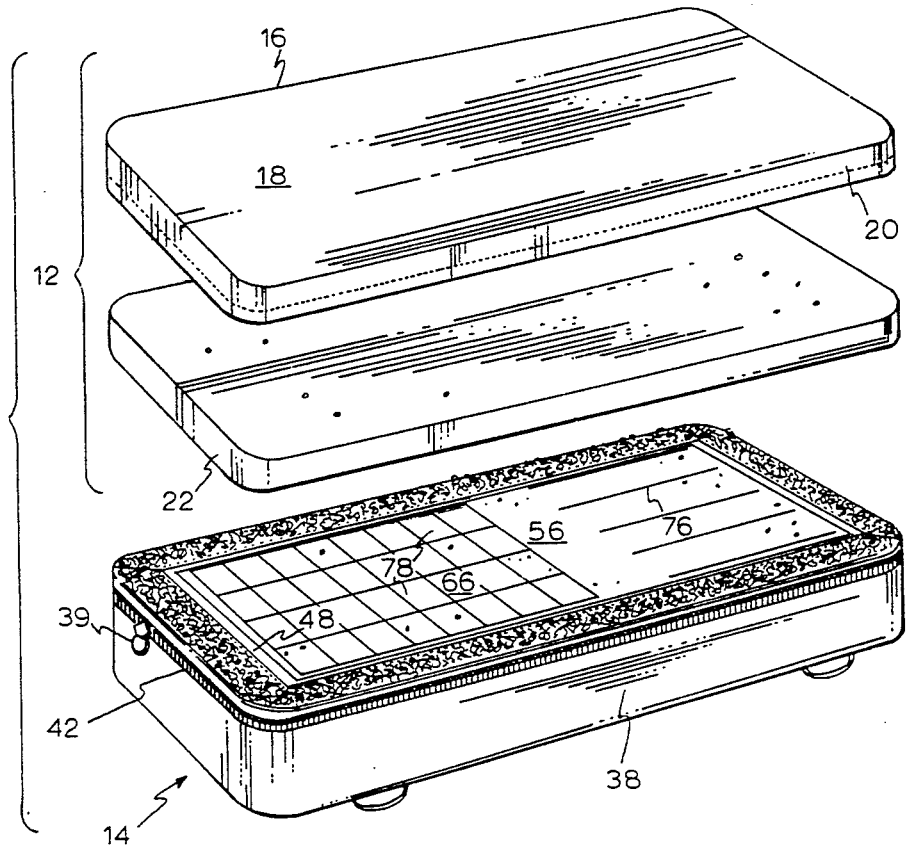
FIG. 1 is an exploded view of the mattress of the present invention.

Referring to the Figures of the present invention the mattress 10 of the present invention, is shown formed in an upper half 12 and a lower half 14. The upper half 12 consists of a loose upper cover 16 having a top surface 18 and descending sides 20 enclosing the sides of foam material layer 22 having a rectangular solid shape. One half of a zipper 24 is attached to the inside flat surface 26 of the descending portion sides 20 so that a portion 28 of the descending sides 20 extends beyond the zipper portion 24. The zipper portion 24 extends substantially around the periphery of the descending sides 20.

As shown in FIG. 5 the bottom surface 30 of the upper foam layer 22 has an attached fabric layer 32 around its periphery. In the preferred embodiment this fabric layer 32 is attached to the upper foam layer 22 by adhesive or other suitable means, such as by sewing.

Attached to the fabric layer 32 is one half of a hook and loop removable connector means 35, such as is sold under the trademark Velcro. The removable connector means 35 surrounds substantially the entire periphery of the upper foam layer 22. However, for ease of accessing removable connector means 35, spaces 37, 41, 43 & 45 in FIG. 5 may be left in the connector means for insertion of the operator's fingers.

In the preferred embodiment the upper foam layer 22 is approximately seventy-five to eighty-four inches long, thirty to thirty-five inches wide, and one and one-half inches thick. The foam material is made from polyurethane foam of: approximately one point eight density, open cell construction, anti-microbial nature, flame retardant nature, and other safety characteristics. The upper cover 16 is made of seventy denier, coated nylon taffeta and is larger in width and length than the upper foam layer so as to permit a loose billowy fit of the top 18 over the upper foam layer 22. Dimensions of cover 16 may include having a width of thirty-eight to forty-four inches, a length of eighty-three to ninety-three inches, and a hem of seven-eighths of an inch to the point where the zipper attaches to the cover. The cover 16 is or may be anti-bacterial, flame retardant, moisture resistant, and the like. The upper foam layer 22 is of such a size so that it fits snugly within the descending sides 20 of the cover 16. The top surface 18 is integrally attached to the depending sides 20 of the upper cover 16, as both top and sides are all one piece.

The descending sides 20 of the upper cover 16 extend about three and one-fourth inches from the top surface 18 and about one-half inches beyond the zipper portion 24.

The fabric layer 32 is about three inches wide and the removable connector means 35 is approximately one and one-half inches wide.

The lower half 14 consists of a bottom cover 34 having a bottom surface 36 and upraised sides 38 enclosing the sides of a lower foam layer 66 having a rectangular solid shape. The lower foam layer 66 is thicker than the upper foam layer 22. The corresponding portion of a zipper 42, corresponding to the other half of zipper portion 24, is not attached to the top most portion 44 of the upraised side 38. Instead, a barrier is formed behind the zipper by attaching the corresponding zipper portion 42 below the top portion 44 of the upraised side 38. Both the barrier and the zipper proceed around substantially the entire periphery of the upraised sides 38.

Figure 2:
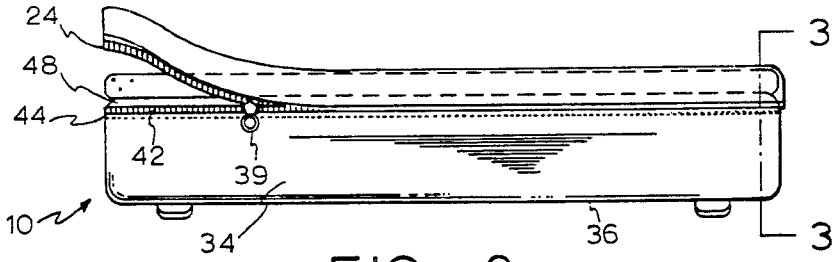
FIG. 2 is a side view of the present invention, with a portion of the mattress unzipped.
Figure 3:
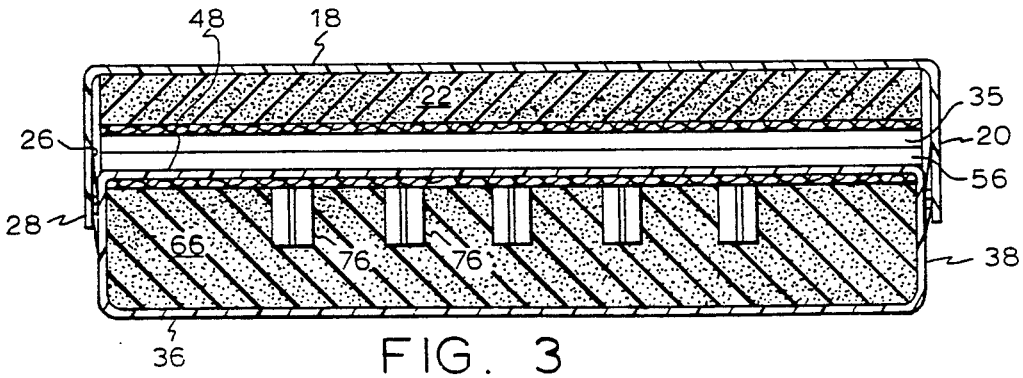
FIG. 3 is a side sectional view taken along lines 3—3 of FIG. 2.

As shown in FIGS. 2 and 3 the bottom cover 34 has an extension member 48 extending around the top of the upraised sides 38 in a plane substantially parallel to the bottom surface 36. The lower foam layer 66 is enclosed within the partially enclosed space formed by the bottom surface 36, the upraised sides 38 and the extension member 48 of the bottom cover 34. The extension member 48 has an overlaying hook and fabric removable connector 56 corresponding to the other portion of the hook and fabric removable connector 35 attached to the upper foam layer 22 of the upper half 12. The hook and fabric removable connector 56 may be attached by adhesive, sewing or any other means. The bottom surface 36 is sewn to the upraised sides 38 of the bottom cover 34. Cloth handles 58, 60, 62 and 64 are sewn into the seams connecting the bottom surface 36 and upraised sides 38 of the bottom cover 34.

In the preferred embodiment the lower foam layer 66 is approximately seventy-five to eighty-four inches long, thirty to thirty-five inches wide and four and three-quarters inches thick. The lower foam layer includes two foam layers laminated together. The first lower layer is three inches thick with cuts 76 and squares 78. The second lower layer of the lower mattress layer is one and three-quarters inches thick and acts as a supporting base for the first lower layer. The foam material is made from polyurethane foam with such preferred characteristics as: approximately one point eight density, open cell construction, anti-microbial properties, flame retardant capacities, and other safety features. The bottom cover 34 is made of laminated vinyl synthetic fabric and is slightly larger than the lower foam portion in width and length so as to permit a relatively snug fit over the lower foam layer 66. The bottom cover may have thirteen point four ounces weight, anti-bacterial properties, flame retardant properties, and be moisture and stain resistant. The bottom cover 34 retains the lower foam layer 66 within the enclosed space. An approximately one inch surplus of width and length for the cover is usually sufficient. The lower foam layer 66 is pliable so that it can be compressed and deformed so that it fits within the enclosed space formed by the bottom cover 34.

The upraising sides 38 of the bottom cover 34 are eight inches wide, including seam, lip, flap, and the barrier behind the zipper. The extension member 48 is about two inches wide and the removable connector means 56 is approximately one and one-half inches wide.

In the preferred embodiment, as shown in FIG. 6, the upper surface 70 of the lower foam layer 66 has a plurality of body pressure relief cuts 76 and removable cubes 78, such as are well known in the art.

Referring to FIGS. 1 through 4, the mattress 10 is assembled by first inserting the bottom foam half 66 of the mattress inside the bottom cover 34 so that the cuts 76 and blocks 78 are exposed. The upper foam half of the mattress 22 is attached to the bottom half 66 by the hook and loop attachment means. The upper cover 16 is laid over the exposed upper half and zipped to the bottom cover 34 by the zipper halves 24 and 42.

As shown in FIG. 3, due to the fact that the upper half of the zipper 24 is set on the inside of the descending sides 20 of the upper cover 16 away from the end of the descending side 20 of the upper cover 16, and due to the fact that the lower foam layer 66 is enclosed within the bottom cover 34, the space between the teeth of the zipper is covered. Any fluid or other material that may pass through the space in the zipper is prevented from coming into contact with either the upper foam layer 22 or the lower foam layer 66, both layers being protected by the layers of the sides 20 of the upper cover 16 and the barrier behind the zipper formed by the upper sides 38 of the lower cover 34.

The above construction permits the upper cover 16, the lower cover 34, the upper foam layer 22 and the lower foam layer 66 to all be separately replaced should any of these parts be damaged. Also, the construction provides for a simple means of maintaining the two halves of the mattress in a fixed relationship to one another in an inexpensive and simple way. The top cover 16 easily lays atop the upper foam layer 22, permitting a loose billowy effect to be achieved by the top cover. Also, the simple configuration permits the separation of the top half 12 from the bottom half 14 so that the two halves 12, 14 and their covers 16, 34 can then be shipped and stored separately.

While the present invention has been described with regards to the preferred embodiment, it is understood that variation to the present invention may be made without departing from the concept of the present invention.

For example, while in the preferred embodiment of the invention the bottom cover 34 has the removal connector means 56 attached to the extension member 48, it is possible to have the removable connector means 56 attached directly to the lower foam layer 66 so that the removable connector 56 attaches directly to the corresponding connector means 35 on the upper foam layer 22. The lower foam layer 66 can be attached to the bottom cover 34 by any suitable means, including the use of the extension member 48 to prevent movement of the lower foam layer 66 in relationship to the bottom cover 34.

Also, while in the preferred embodiment the lower foam layer 66 is partially enclosed by the bottom cover 34, the upper foam layer 22 could be partially enclosed or both the upper and lower foam layers 22 and 66 could be partially enclosed with the removable connectors 35 and 56 being fixed on both the upper cover 16 and bottom cover 34 to maintain the upper foam layer 22 and the lower foam layer 66 fixed to one another.

Also, in place of a zipper 24, 42 for connecting the upper cover 16 and bottom cover 34, other removable connector means may be used, such as hook and loop connectors. Also, a hook and loop connector means can be used to hold the descending sides 20 attached to the bottom cover 34 to further prevent any fluids or contaminates from entering through the space between the teeth of the zipper 24, 42.

What is claimed is:

1. A mattress comprising:

a first foam layer having top, bottom and sides;

a second foam layer having top, bottom and sides;

a corresponding first cover portion having a top and sides enclosing at least the top and sides of said first foam layer;

a corresponding second cover portion having a bottom and sides enclosing at least the bottom and sides of said second foam layer, said first cover portion attaching to said second cover portion by zipper means for removable attachment said zipper being covered on both its interior and exterior sides by at least one of said sides of said first and second covers;

means for removably fixing said first foam layer in relation to said second foam layer; and means for fixing at least one of said foam layers in relationship to its corresponding cover.

2. A mattress comprising:

a first foam layer having top, bottom and sides;

a second rectangular foam layer having top, bottom and sides;

a first cover portion having a top and descending sides; and a second cover portion having an extension portion extending substantially perpendicularly from an upstanding side of said second cover portion and having one portion of a hook and loop connector fixed to said extension portion, said second cover partially enclosing and fixing said second foam layer relative to said second cover portion; whereby the sides of said first cover portion are removably connected to the sides of the second cover portion by zipper means, the bottom of the first foam layer having a portion of a hook and loop connector on its bottom for removably connecting said first foam layer to said extension portion.

3. The mattress of claim 2 in which said zipper means is covered on both interior and exterior sides by said descending sides of said first cover.

4. The mattress of claim 3 in which the hook and loop connection between said first foam layer and said extension portion does not extend entirely around the periphery of said first foam layer and said extension portion.

5. A mattress comprising:

a first foam layer having top, bottom and sides;

a second foam layer having top, bottom and sides;

a first cover portion having a top and descending sides;

a second cover portion having an extension portion extending substantially perpendicularly from an upstanding side of said second cover portion and having one portion of a hook and loop connector fixed to said extension portion, said second cover partially enclosing and fixing said second foam layer relative to said second cover portion; whereby the sides of said first cover portion are removably connected to the sides of the second cover portion by zipper means, said zipper means covered by said descending sides of said first cover, and the bottom of the first foam layer having a portion of a hook and loop connector on its bottom for removably connecting said first foam layer to said extension portion.

6. The mattress of claim 5 in which the hook and loop connection between said first foam layer and said extension portion does not extend entirely around the periphery of said first foam layer and said extension portion.

* * * * *